United States Patent [19]

Shumer

[11] 4,042,264

[45] Aug. 16, 1977

[54] CLAMPING APPARATUS

[76] Inventor: James E. Shumer, 332 W. Broadway, Maumee, Ohio 43537

[21] Appl. No.: 745,859

[22] Filed: Nov. 29, 1976

Related U.S. Application Data

[63] Continuation of Ser. No. 648,116, abandoned.

[51] Int. Cl. ..... B25b 1/02

[52] U.S. Cl. ..... 269/88; 269/203

[58] Field of Search ..... 269/90, 88, 203, 196; 81/154, 148, 149, 186

[56] References Cited

U.S. PATENT DOCUMENTS

| | | | |
|---|---|---|---|
| 391,801 | 10/1888 | Kirkland | 269/88 |
| 707,680 | 8/1902 | De Worth | 269/203 |
| 729,155 | 5/1903 | Gebauer | 81/154 |
| 1,490,343 | 4/1924 | Pietsch | 81/154 |
| 2,909,954 | 10/1959 | Rhoads | 81/186 |
| 3,933,346 | 1/1976 | Carver | 269/88 |

FOREIGN PATENT DOCUMENTS

| | | | |
|---|---|---|---|
| 1,139,366 | 6/1957 | France | 269/196 |

*Primary Examiner*—Robert C. Watson

*Attorney, Agent, or Firm*—Richards, Harris & Medlock

[57] ABSTRACT

A clamping apparatus comprises a frame member, a slider member and a locking member all adapted for manufacture from high strength plastic materials by means of injection molding. The frame member comprises an elongate bar portion and a jaw portion extending perpendicularly to the bar portion. The slider member includes an aperture portion which receives the bar portion of the frame member and a depending jaw portion. The locking member extends through the aperture portion of the slider member and functions to lock the slider member against movement along the bar portion of the frame member.

10 Claims, 5 Drawing Figures

CLAMPING APPARATUS

This is a continuation of application Ser, No. 648,116, filed Jan. 12, 1976, now abandoned.

BACKGROUND AND SUMMARY OF THE INVENTION

This invention relates to clamping apparatus, and more particularly to clamping apparatus comprising injection molded, high strength plastic parts.

Various activities in and around the home, offices, and the like are facilitated by means of clamping apparatus. For example, hobbies such as model making, woodworking, picture framing, etc., often utilize clamping apparatus. Other activities include the assembly and/or repair of objects such as toys, small appliances, and the like.

It will thus be apparent that a need exists for clamping apparatus which is especially suited for home and office use. However, notwithstanding this need, no such clamping apparatus has heretofore been provided. Instead, the various types of clamping apparatus which have been available for such use have generally been precision instruments which have typically been not only expensive to purchase but also delicate in use.

The present invention overcomes the foregoing and other difficulties long since associated with the prior art to provide a clamping apparatus which is both inexpensive to purchase and rugged and adjustment free in service, and is therefore readily adapted to use in and around homes, offices, and the like. In accordance with the broader aspects of the invention, a clamping apparatus is formed entirely from injection molded, high strength plastic parts. The clamping apparatus includes a frame member comprising an elongate bar portion and a jaw portion extending substantially perpendicularly to the bar. A slider member includes an aperture portion which slidably receives the bar portion of the frame member and a depending jaw portion. A locking member extends through the aperture portion of the slider member and functions to lock the slider member against movement along the bar portion of the frame member by camming action.

In accordance with more specific aspects of the invention, the jaw portion of the frame member is H-shaped in cross section to provide inwardly and outwardly facing jaw surfaces. The frame member further includes an actuator portion extending perpendicularly to the bar portion at the same end thereof as the jaw portion. The jaw portion of the slider member is T-shaped in cross section to provide a jaw surface. The aperture portion of the slider member includes an inwardly facing, inclined camming surface. The locking member includes an inclined camming surface which cooperates with the camming surface of the aperture portion of the slider member to lock the slider member against movement along the bar portion of the frame member. The locking member further includes an actuator portion which extends perpendicularly to the camming portion.

In accordance with still other aspects of the invention, the actuator portions of the frame member and the locking member have end surfaces situated in a common plane. This permits the clamping apparatus to be supported on the end surfaces of the actuator members with the jaw portions extending upwardly. The slider member is usually positioned on the bar portion of the frame member with the jaw surface of the jaw portion of the slider member facing the inwardly facing jaw surface of the jaw portion of the frame member. The positioning of the slider member on the bar portion of the frame member may also be reversed, whereby the jaw surface of the jaw portion of the slider member cooperates with the outwardly facing jaw surface of the jaw portion of the frame member to apply outwardly directed forces.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
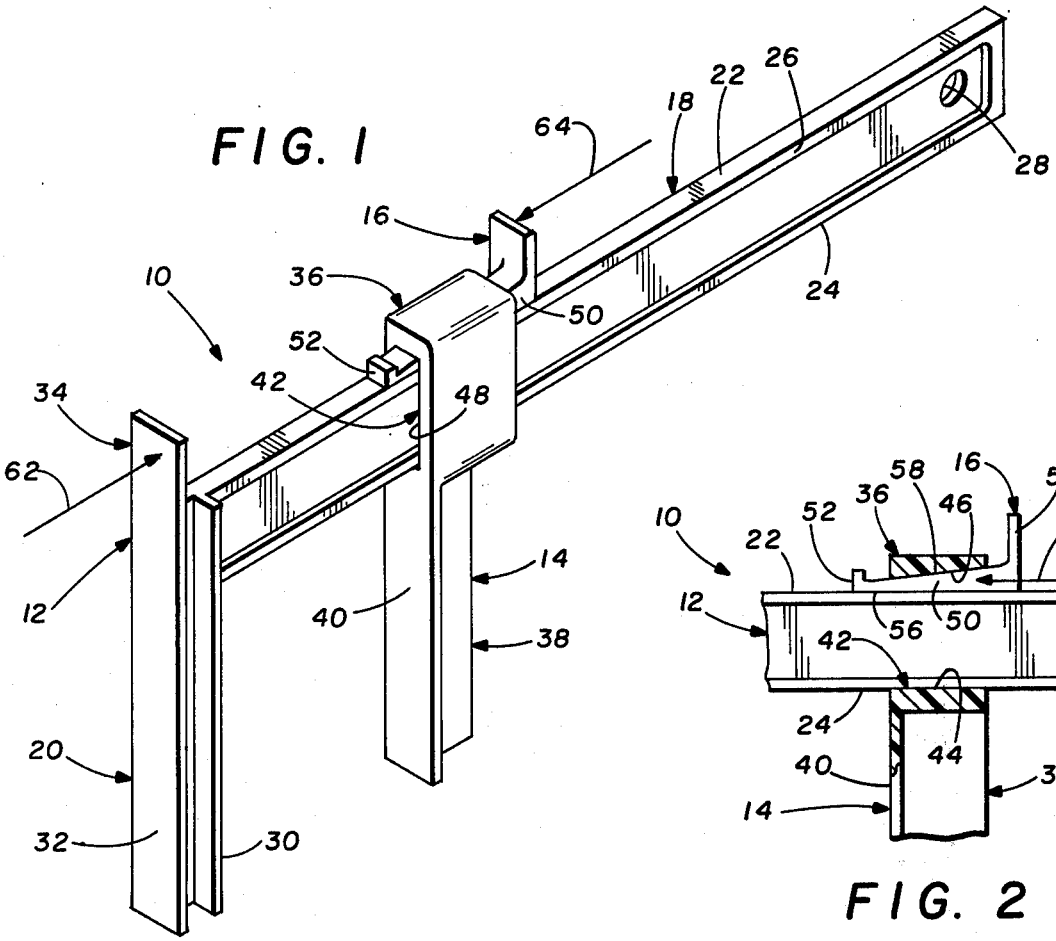
FIG. 1 is a perspective view of a clamping apparatus incorporating the invention.

Referring now to the drawings, and particularly to FIG. 1 thereof, there is shown a clamping apparatus 10 incorporating the invention. The clamping apparatus 10 includes a frame member 12, a slider member 14 and a locking member 16. The frame member 12, the slider member 14 and the locking member 16 are all adapted for manufacture by mass production techniques, and in particular are adapted for manufacture by means of injection molding techniques. The frame member 12, the slider member 14 and the actuator member 16 are each manufactured from one of the high strength thermoplastic materials, with the preferred material being glass-filled polyester. Other high strength thermoplastic materials which may be utilized in the practice of the invention include ABS, nylon, impact polystyrene, acetal, and the like. Other thermoplastic materials may also be utilized in the practice of the invention, if desired.

The frame member 12 of the clamping apparatus 10 includes an elongate bar portion 18 and a jaw portion 20 formed integrally with and extending substantially perpendicularly to the bar portion 18. The bar portion 18 is defined by opposed, substantially flat, substantially parallel walls 22 and 24. The bar portion 18 further comprises a pair of side walls 26 (only one of which is shown) which may be reset, if desired. An aperture 28 may be provided on one end of the bar portion 18 of the frame member 12 for use in hanging the clamping apparatus 10 and articles received therein from a suitable support.

Figure 3:
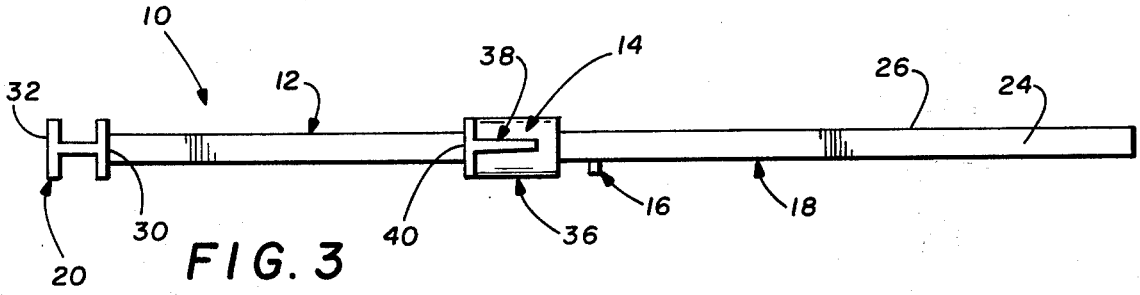
FIG. 3 is a bottom view of the clamping apparatus.
Figure 4:
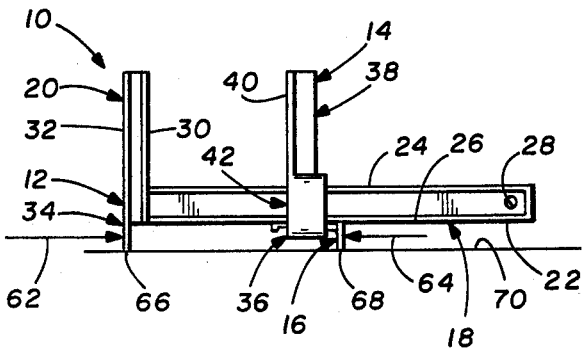
FIGS. 4 and 5 illustrate alternative uses of the clamping apparatus.
Figure 5:
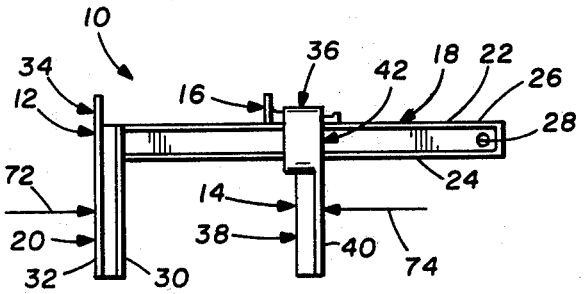

Referring momentarily to FIG. 3, the jaw portion 20 of the frame member 12 is substantially H-shaped in cross section throughout its length. By this means the jaw portion 20 defines an inwardly facing jaw surface 30 and an outwardly facing jaw surface 32. With respect to the outwardly facing jaw surface 32, the midportion thereof relative to the length of the jaw portion 20 may be omitted to effect material savings, if desired. As is best shown in FIGS. 1, 4 and 5, the portion of the jaw portion 20 of the frame member 12 defining the outwardly facing jaw surface 32 extends beyond the bar portion 18 and substantially perpendicularly with respect thereto to define an actuator portion 34 which is formed integrally with the bar portion 18 and the jaw portion 20 of the frame member 12.

Figure 2:
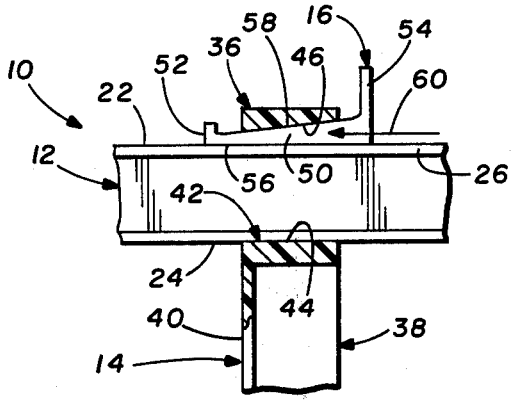
FIG. 2 is a partial side view of the clamping apparatus in which certain parts have been broken away more clearly to illustrate certain features of the invention.

Referring to FIGS. 1, 2 and 3, the slider member 14 of the clamping apparatus 10 includes an aperture portion 36 and a jaw portion 38. The jaw portion 38 is formed integrally with the aperture portion 36 and depends therefrom. The jaw portion 38 is T-shaped in cross section throughout its length and thus defines a jaw surface 40.

Referring particularly to FIG. 2, the aperture portion 36 of the slider member 14 includes an aperture 42 which surrounds the bar portion 18 of the frame member 12. The aperture 42 includes a flat surface 44 which engages the surface 24 of the bar portion 18 and an opposed, inwardly facing, inclined camming surface 46. As is best shown in FIG. 1, the aperture 42 is completed by a pair of surfaces 48 (only one of which is shown) which extend adjacent the walls 26 of the bar portion 18.

The locking member 16 includes a cam portion 50 extending to a retaining tip 52 and an actuator portion 54. The cam portion 50 extends through the aperture 42 of the slider member 14. The cam portion 50 includes a flat surface 56 which engages the surface 26 of the bar portion 18 of the frame member 12 and an inclined camming surface 58 which engages the camming surface 46 of the aperture 42. Thus, upon movement of the locking member 16 relative to the slider member 14 in the direction of the arrow 60, the locking member 16 functions to lock the slider member 14 against sliding movement along the length of the bar portion 18 of the frame member 12. Conversely, movement of the locking member 16 relative to the slider member 14 in the direction opposite to that of the arrow 16 releases the slider member 14 for sliding movement axially along the bar portion 18. The tip 52 prevents removal of the locking member 16 from the aperture 42 except upon disengagement of the slider member 14 from the end of the bar portion 18 remote from the jaw portion 20.

The tip 52 and the actuator portion 54 of the locking member 16 are formed integrally with the camming portion 50. The actuator portion 54 extends perpendicularly to the camming portion 50 and cooperates with the actuator portion 34 of the frame member 12 to effect operation of the clamping apparatus 10. Thus, the actuator portion 34 and the actuator portion 54 are preferably positioned for engagement by the thumb and forefinger of an operator to apply opposed forces as indicated by the arrows 62 and 64. The slider member 14 is thus moved axially along the bar portion 18 of the frame member 12 until an object positioned between the jaw portion 20 of the frame member 12 and the jaw portion 38 of the slider member 14 is engaged by the jaw surfaces 30 and 40, whereupon the locking member 16 moves relative to the slider member 14 to lock the slider member 14 in position on the bar portion 18. At this point the object is securely clamped between the jaw surfaces 30 and 40 of the clamping apparatus 10. Release of the object is effected by simply moving the actuator portion 54 of the locking member 16 in the direction opposite to that of the arrow 64, whereupon the slider member 14 is quickly and easily moved out of engagement with the object and the object is released.

FIGS. 4 and 5 illustrate alternative uses for the clamping apparatus 10. Referring to FIG. 4, the actuator portions 34 and 54 have end surfaces 66 and 68, respectively, which lie in a common plane. This permits the end surfaces 66 and 68 to be engaged with a surface 70, whereby the clamping apparatus 10 may be positioned with the jaw portions 20 and 38 extending upwardly. This is highly advantageous with respect to certain applications of the invention.

In FIG. 5 the clamping apparatus 10 is shown with the slider member 14 positioned on the bar portion 18 of the frame member 12 in a reversed orientation. This is accomplished by simply moving the slider member 14 axially along the bar portion 18 until it disengaged from the end thereof remote from the jaw portion 20. The orientation of the slider member 14 is then reversed and the slider member 14 is reengaged with the bar portion 18 in the reversed orientation. The positioning of the slider member 14 as illustrated in FIG. 5 is useful when the clamping apparatus 10 is utilized to apply outwardly directed forces to an object having portions oriented as illustrated by the arrows 72 and 74.

From the foregoing, it will be understood that the present invention comprises a clamping apparatus in which all of the parts are adapted for manufacture by injection molding techniques from high strength plastic materials. Clamping apparatus incorporating the invention is thus economical to purchase and is rugged and adjustment free in service. Clamping apparatus constructed in accordance with the invention is highly useful in and around homes, offices, and the like for such purposes as hobbies, repair and maintenance operations, and related purposes. Other advantages deriving from the use of the invention will readily suggest themselves to those skilled in the art.

I claim:

1. Clamping apparatus comprising:

a molded plastic, generally L-shaped frame member including an elongate bar portion and a jaw portion formed integrally with the bar portion and extending substantially perpendicularly with respect thereto;

the jaw portion of the frame member being substantially H-shaped in cross section at least adjacent its distal end to provide opposed inwardly facing and outwardly facing jaw surfaces;

said inwardly and outwardly facing jaw surfaces extending substantially parallel to each other and substantially perpendicularly to the bar portion of the frame member;

a molded plastic slider member including an aperture portion defining an axis and a jaw portion formed integrally with the aperture portion and depending therefrom substantially perpendicularly to the axis;

the jaw portion of the slider member being substantially T-shaped in cross section throughout its length to define a jaw surface;

said jaw surface of the slider member extending substantially parallel to the inwardly and outwardly facing jaw surfaces of the jaw portion of the free member;

the slider member being normally positioned on the bar portion of the frame member with the jaw surface of the slider member facing the inwardly facing jaw surface of the frame member to apply inwardly directed forces therebetween and the positioning of the slider member on the bar portion of the frame member being reversible so that the jaw surface of the jaw portion of the slider member cooperates with the outwardly facing jaw surface of the jaw portion of the frame member to apply outwardly directed forces therebetween;

the aperture portion of the jaw member defining an inclined camming surface on an inside surface thereof;

a molded plastic locking member comprising a camming portion and an actuator portion formed integrally therewith;

the camming portion of the locking member extending through the aperture of the aperture portion of the slider member and engaging the bar portion of the frame member along substantially the entire length of said bar portion when said slider member is normally positioned or reversibly positioned on the bar portion of the frame member, such that the inwardly and outwardly directed forces between the jaw surface of said frame member and the jaw surface of said slider member are selectively positioned along substantially the entire length of said bar portion;

the camming portion of the locking member defining an outwardly facing camming surface for cooperation with the inwardly facing camming surface of the aperture portion of the slider member to lock the slider member against movement along the bar portion of the frame member and extending to an outwardly projecting tip for preventing disengagement of the locking member from the aperture of the slider member; and the actuator portion of the locking member extending substantially perpendicularly to the camming portion thereof to first advance the slider member along the bar portion of the frame member and then lock the slider member either in engagement with an object situated between the jaw surface of the jaw portion of the slider member and the inwardly facing jaw surface of the frame member, or in separating objects by the outwardly directed forces of the jaw surface of the jaw portion of the slider member cooperating with the outwardly facing surface of the jaw portion of the frame member.

2. The clamping apparatus according to claim 1 wherein the bar portion of the frame member comprises opposed, substantially flat, substantially parallel surfaces, wherein the aperture of the slider member includes a surface which engages one of the flat, parallel surfaces of the bar portion, and wherein the camming portion of the locking member includes a surface which engages the other flat, parallel surface of the bar portion.

3. The clamping apparatus of claim 1 further including an actuator portion formed integrally with the bar portion and the jaw portion and extending substantially perpendicularly from the bar portion at the same end thereof as the jaw portion.

4. The clamping apparatus according to claim 3 wherein the actuator portion of the frame member and the actuator portion of the locking member extend to end surfaces situated in a common plane, whereby the clamping apparatus may be supported on the end surfaces of the actuator members with the jaw portions extending outwardly.

5. The clamping apparatus according to claim 1 wherein the frame member, the slider member and the locking member are all fabricated by means of injection molding.

6. The clamping apparatus according to claim 1 wherein the frame member, the slider member and the locking member are all fabricated from glass filled polyester.

7. The clamping apparatus comprising:

a generally L-shaped frame member including an elongate bar portion defined by opposed, substantially flat, substantially parallel surfaces and a jaw portion formed integrally with the bar portion and extending substantially perpendicularly with respect thereto;

the jaw portion of the frame member being substantially H-shaped in cross section throughout its length to provide opposed inwardly and outwardly facing jaw surfaces having surfaces for clamping along its entire length;

said inwardly and outwardly facing jaw surfaces extending substantially parallel to each other and substantially perpendicularly to the bar portion of the frame member;

a molded plastic slider member including an aperture portion defining an axis and a jaw portion formed integrally with the aperture portion and depending therefrom substantially perpendicularly to the axis;

the jaw portion of the slider member being substantially T-shaped in cross section throughout its length to define a jaw surface for clamping along its entire length;

said jaw surface of the slider member extending substantially parallel to the inwardly and outwardly facing jaw surfaces of the jaw portion of the frame member;

the slider member being normally positioned on the bar portion of the frame member with the jaw surface of the slider member facing the inwardly facing jaw surface of the frame member to apply inwardly directed forces therebetween and the positioning of the slider member on the bar portion of the frame member being reversible so that the jaw surface of the jaw portion of the slider member cooperates with the outwardly facing jaw surface of the jaw portion of the frame member to apply outwardly directed forces therebetween;

the aperture portion of the jaw member defining an aperture including a surface and normally engaging one of the flat, parallel surfaces of the bar portion of the frame member and an opposed, inclined camming surface;

a locking member comprising a camming portion and an actuator portion formed integrally therewith;

the camming portion of the locking member including a surface normally engaging the other flat, parallel surface of the bar portion of the frame member and an opposed, inclined camming surface normally engaging the camming surface of the aperture of the aperture portion of the slider member;

the camming portion of the locking member normally engaging said other flat, parallel surface of the bar portion of the frame member along substantially the entire length of said bar portion when said slider member is normally positioned or reversibly positioned on the bar portion of the frame member, such that the inwardly and outwardly directed forces between the jaw surface of said frame member and the jaw surface of said slider member are selectively positioned along substantially the entire length of said bar portion;

the camming portion of the locking member extending to an outwardly projecting tip for normally preventing disengagement of the locking member from the aperture of the slider member; and the actuator portion of the locking member extending substantially perpendicularly to the camming portion thereof to first advance the slider member along the bar portion of the frame member and then lock the slider member in engagement with an object situated between the jaw surfaces of the jaw portions of the frame member and the slider member by movement relative to the slider member and to locking engagement between the adjacent flat, parallel surfaces of the bar portion of the frame member and the adjacent inclined camming surface of the aperture portion of the slider member.

8. The clamping apparatus of claim 7 further including an actuator portion formed integrally with the bar portion and the jaw portion and extending substantially perpendicularly from the bar portion at the same end thereof as the jaw portion.

9. The clamping apparatus according to claim 8 wherein the actuator portion of the frame member and the actuator portion of the locking member extend to end surfaces situated in a common plane so that the clamping apparatus may be supported on the end surfaces of the actuator members with the jaw portions extending outwardly.

10. The clamping apparatus according to claim 7 wherein the frame member, the slider member and the locking member are all fabricated from glass filled polyester plastic material by means of injection molding.

* * * * *